US010343448B2

(12) United States Patent
Smith

(10) Patent No.: US 10,343,448 B2
(45) Date of Patent: Jul. 9, 2019

(54) RE-USABLE PAINT TRAY LINER BAG

(71) Applicant: David S. Smith, Highland, IN (US)

(72) Inventor: David S. Smith, Highland, IN (US)

( * ) Notice: Subject to any disclaimer, the term of this patent is extended or adjusted under 35 U.S.C. 154(b) by 0 days.

(21) Appl. No.: 13/844,041

(22) Filed: Mar. 15, 2013

(65) Prior Publication Data

US 2014/0260105 A1 Sep. 18, 2014

(51) Int. Cl.
*B44D 3/12* (2006.01)

(52) U.S. Cl.
CPC ..... *B44D 3/126* (2013.01); *Y10T 29/49815* (2015.01)

(58) Field of Classification Search
CPC ..... B44D 3/127; B44D 3/126
USPC ..... 220/495.02
See application file for complete search history.

(56) References Cited

U.S. PATENT DOCUMENTS 3,514,012 A * 5/1970 Martin ..... B44D 3/126 15/257.06
3,752,494 A * 8/1973 Dunn ..... B44D 3/126 15/257.06
4,765,123 A * 8/1988 Caldwell ..... B44D 3/126 220/570
5,460,289 A * 10/1995 Gemmell ..... B44D 3/12 220/495.02

* cited by examiner

*Primary Examiner* — Stephen J Castellano
(74) *Attorney, Agent, or Firm* — Dunlap Bennett & Ludwig PLLC

(57) ABSTRACT

A paint tray liner bag can fully encapsulate a rigid paint tray and fully form to the shape of the rigid paint tray. The paint tray liner bag includes a bag flap that folds over to the bottom of the rigid paint tray and has holes to receive the legs of the rigid paint tray, thereby securing the paint tray liner bag on the rigid paint tray. Unlike rigid paint trays, that do not fit well into sinks and have ridges that can be difficult to clean, the paint tray liner bag can be removed from the rigid paint tray and easily cleaned due to its smooth surface and flexibility to fit into a user's sink.

3 Claims, 3 Drawing Sheets

RE-USABLE PAINT TRAY LINER BAG

BACKGROUND OF THE INVENTION

The present invention relates to painting supplies and, more particularly, to a re-usable paint tray liner bag for covering a paint tray.

Rigid paint trays, often made of plastic or aluminum, are conventionally used to hold paint and provide a surface with ridges to remove excess paint from a paint roller. After use, a user has the option of discarding the paint tray, which can be expensive and environmentally unfriendly, or cleaning the paint tray. Because they are large and rigid, they can be difficult to clean. With the ridges, it can be difficult to remove all the paint from the paint tray. Any paint left in the over runs the risk of contaminating a later painting project, possibly leaving paint chips of different colors coming off in the later painting project.

To help counter this problem, paint accessories manufacturers have developed thin, disposable paint tray liners that fit into the rigid paint trays. While this solution allows re-use of the rigid paint trays, these thin plastic tray liners often do not fit well into the rigid paint trays and are usually too flexible to be used without the rigid paint tray. Often times, these liners get bent and twisted when being fit into a rigid paint tray. These bends can allow paint to leak into the rigid paint tray or make removing excess paint from the paint roller more difficult.

Other solutions include wrapping plastic wrap or foil over the top of the rigid paint tray to prevent cross-contamination. While these methods can work, they take time to set up and cannot be easily cleaned or re-used.

As can be seen, there is a need for a re-usable, paint tray liner that can fit over a rigid paint tray, can be easily removed, and does not interfere with the function of the rigid paint tray.

SUMMARY OF THE INVENTION

In one aspect of the present invention, a paint tray liner bag comprises a flexible, water-proof bag having an open end; first and second notches formed on a bottom side at the open end; a bag flap extending from a top side of the open end; first and second leg holes cut in the bag flap, wherein the paint tray liner bag holds a rigid paint tray therein, where the first and second notches receive legs of the rigid paint tray and the bag flap folds from a top side of the rigid paint tray to the back side of the rigid paint tray and the legs of the rigid paint tray are received through the first and second leg holes.

In another aspect of the present invention, a method for painting with a paint roller comprises inserting a rigid paint tray into a paint tray liner bag, the paint tray liner bag being a flexible, water-proof bag having an open end with first and second notches formed on a bottom side at the open end, a bag flap extending from a top side of the open end, and first and second leg holes cut in the bag flap; folding the bag flap over from a top side of the rigid paint tray to the back side of the rigid paint tray; receiving legs of the rigid paint tray into the first and second leg holes; and pouring paint into a paint cavity region of the rigid paint tray covered with the paint tray liner bag to cause the paint tray liner bag to take on the shape of the rigid paint tray.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a paint tray liner bag that can fully encapsulate a rigid paint tray and fully form to the shape of the rigid paint tray. The paint tray liner bag includes a bag flap that folds over to the bottom of the rigid paint tray and has holes to receive the legs of the rigid paint tray, thereby securing the paint tray liner bag on the rigid paint tray. Unlike rigid paint trays, that do not fit well into sinks and have ridges that can be difficult to clean, the paint tray liner bag can be removed from the rigid paint tray and easily cleaned due to its smooth surface and flexibility to fit into a user's sink.

Figure 1:
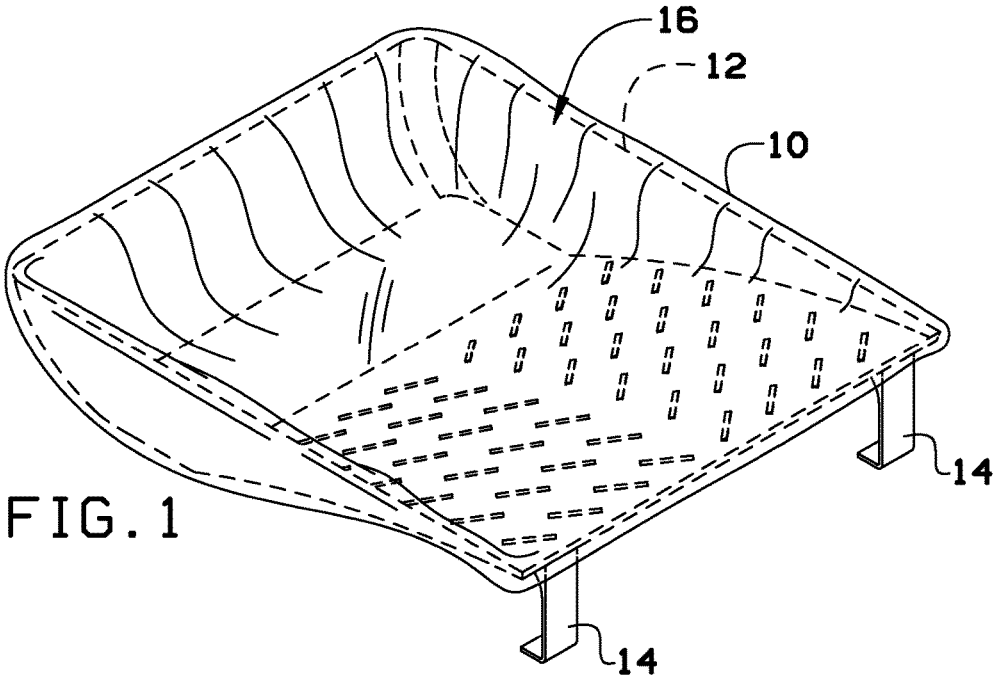
FIG. 1 is a top perspective view of a paint tray liner bag, disposed on a rigid paint tray, according to an exemplary embodiment of the present invention.
Figure 2:
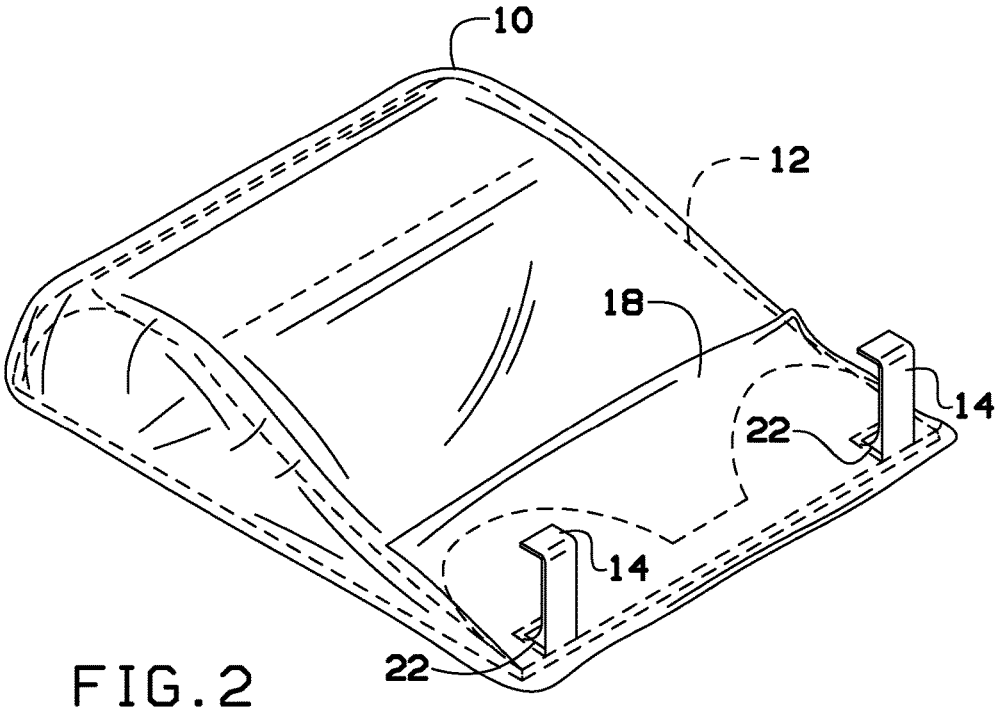
FIG. 2 is a bottom perspective view of the paint tray liner bag of FIG. 1, disposed on the rigid paint tray.
Figure 3:
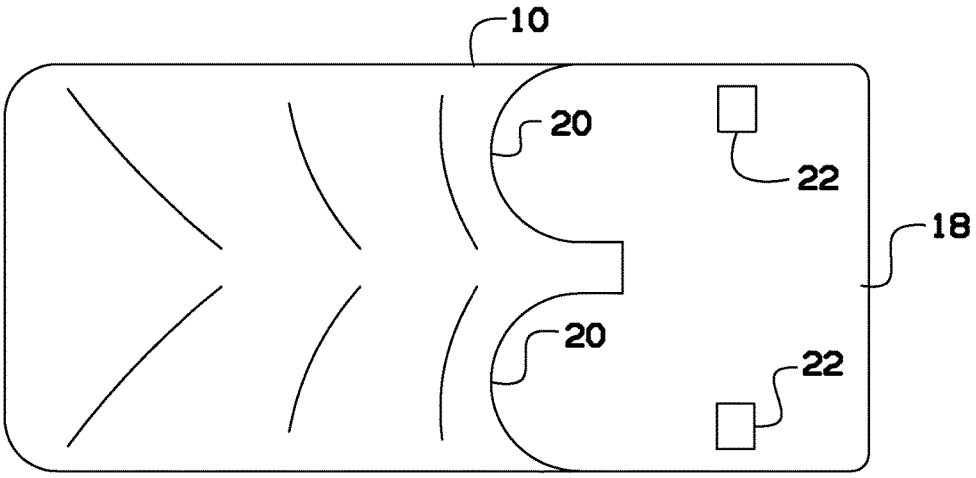
FIG. 3 is a bottom view of the paint tray liner bag or FIG. 1.
Figure 4:
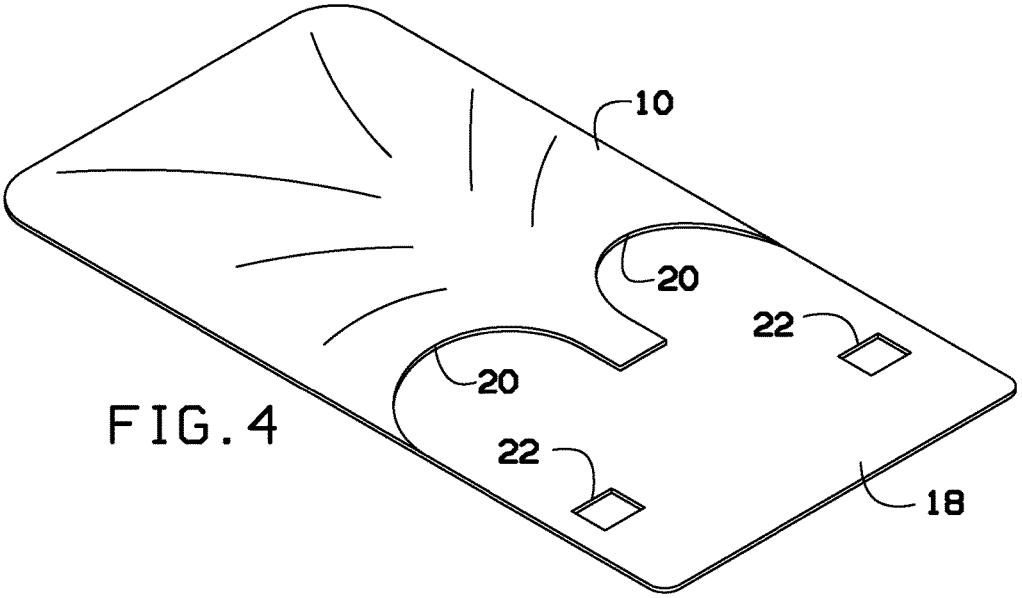
FIG. 4 is a bottom perspective view of the paint tray liner bag of FIG. 1.
Figures 5, 6:
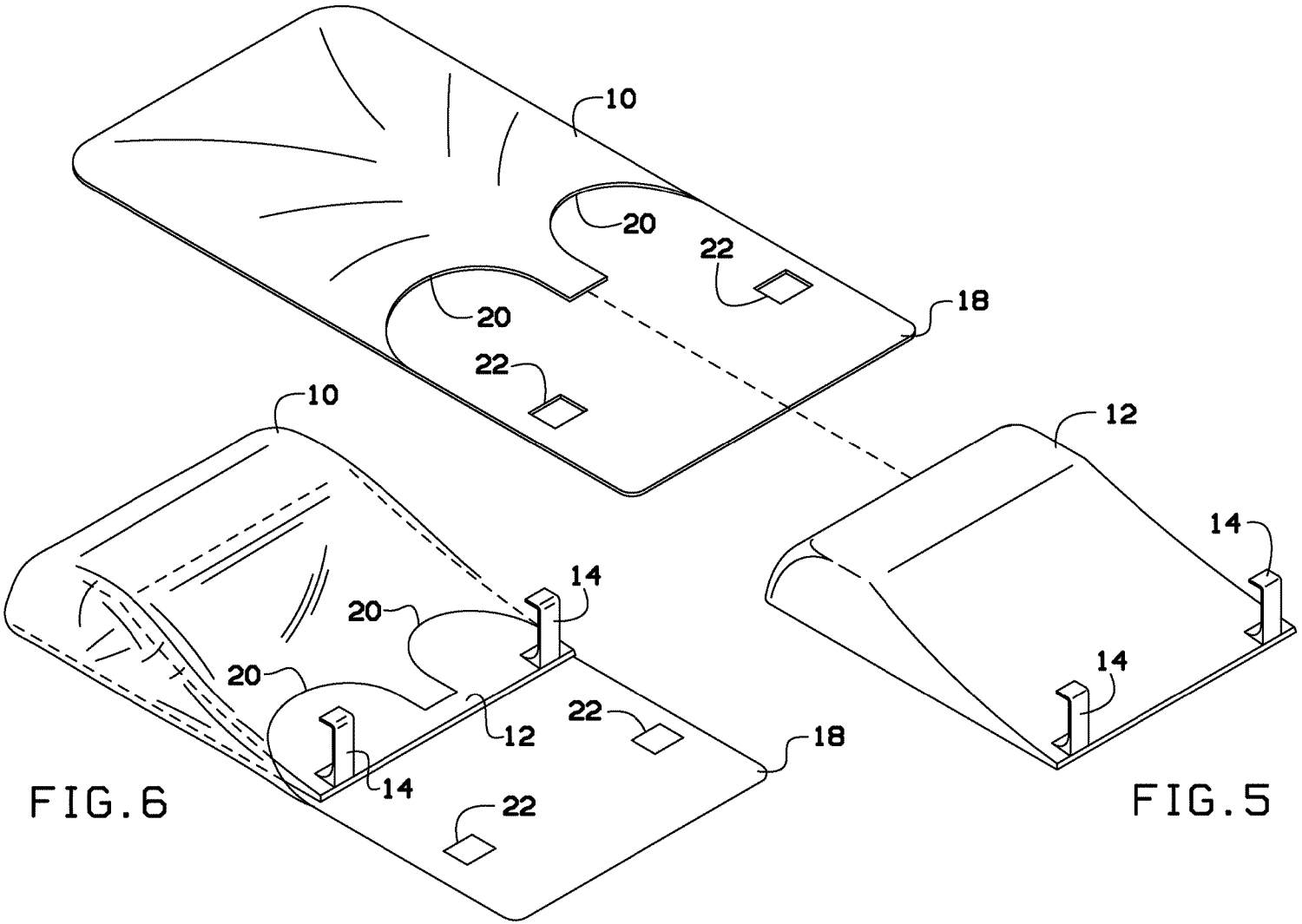
FIG. 5 is a bottom perspective view of the paint tray liner bag of FIG. 1, illustrating application on the rigid paint tray.
FIG. 6 is a bottom perspective view of the paint tray liner bag of FIG. 1, illustrating the paint tray liner bag prior to folding a bag flap over the back side and onto the legs of the rigid paint tray.

Referring now to FIGS. 1 through 6, a paint tray liner bag 10 can be designed as a three-sided-sealed bag having an opening at one end thereof. The paint tray liner bag 10 can have a rigid paint tray 12 inserted therein, as shown in FIG. 5, with a paint cavity region 16 being inserted first into the paint tray liner bag 10.

The paint tray liner bag 10 can have two paint tray leg notches 20 cut out of a back side thereof. A liner bag flap 18 can extend from the top side of the paint tray liner bag 10. Two leg holes 22 can be cut in the liner bag flap 18 so that, when the liner bag flap 18 is folded over the end of the rigid paint tray liner, the leg holes 22 can fit over the legs 14 of the rigid paint tray 12.

The paint tray liner bag 10 can form to the shape of the rigid paint tray 12, allowing the user to take advantage of the formed ridges of the rigid paint tray 12 for removing excess paint on a paint roller. The paint tray liner bag 10 also allows the legs 14 to extend through so not to interfere with the leg's ability to hook onto a desired surface.

The paint tray liner bag 10 can be easily cleaned. Because the paint tray liner bag 10 is smooth and flexible, it can be easily cleaned and removed of paint for re-use.

The paint tray liner bag 10 can be made of a flexible, water-proof material, such as a plastic material, for example. The paint tray liner bag 10 can be made in various thicknesses. For example, a thin paint tray liner bag 10 can be made and designed as a disposable product while a thicker paint tray liner bag 10 can be made and designed for being cleaned and re-used. The paint tray liner bag 10 can be made from recyclable material, for example.

The paint tray liner bag 10 can be designed in various sized to fit different sizes of rigid paint trays. For example, the paint tray liner bag can be designed to fit over a rigid paint tray designed for a standard 9-inch paint roller. Other paint tray liner bags can be designed for use with rigid paint trays designed for 14-inch rollers, 3-inch rollers, 4-inch rollers or the like.

It should be understood, of course, that the foregoing relates to exemplary embodiments of the invention and that modifications may be made without departing from the spirit and scope of the invention as set forth in the following claims.

What is claimed is:

1. A paint tray liner bag comprising:

a flexible, water-proof bag having an open end;

first and second notches formed on a bottom side at the open end;

a bag flap extending from a top side of the open end;

first and second leg holes cut in the bag flap, wherein the paint tray liner bag holds a rigid paint tray therein, where the first and second notches receive legs of the rigid paint tray and the bag flap folds from a top side of the rigid paint tray to the back side of the rigid paint tray and the legs of the rigid paint tray are received through the first and second leg holes.

2. The paint tray liner bag of claim 1, wherein the paint tray liner bag is formed of a plastic material.

3. The paint tray liner bag of claim 1, wherein the paint tray liner bag takes on a shape of a paint cavity region of the rigid paint tray.

* * * * *